United States Patent [19]

Susuki

[11] 4,038,958

[45] Aug. 2, 1977

[54] FUEL INJECTION PUMP GOVERNOR

[75] Inventor: Yasuhide Susuki, Saitama, Japan

[73] Assignee: Diesel Kiki Co., Tokyo, Japan

[21] Appl. No.: 570,452

[22] Filed: Apr. 22, 1975

[30] Foreign Application Priority Data

Apr. 23, 1974 Japan ..... 49-45099

[51] Int. Cl.[2] ..... F02D 1/04

[52] U.S. Cl. ..... 123/140 R; 123/140 J

[58] Field of Search ..... 123/140 R, 140 J

[56] References Cited

U.S. PATENT DOCUMENTS

| | | | |
|---|---|---|---|
| 3,530,845 | 9/1970 | Staudt et al. | 123/140 R |
| 3,577,968 | 5/1971 | Staudt et al. | 123/140 R |
| 3,672,343 | 6/1972 | Biechl et al. | 123/140 R |
| 3,759,236 | 9/1973 | Staudt et al. | 123/140 R |
| 3,884,206 | 6/1975 | Ritter | 123/140 R |
| 3,903,860 | 9/1975 | Maler | 123/140 R |

*Primary Examiner*—Carroll B. Dority, Jr.

*Assistant Examiner*—David D. Reynolds

*Attorney, Agent, or Firm*—Edward F. Connors

[57] ABSTRACT

A flyweight assembly and a manual speed control member are connected through a linkage to a control rod which controls the fuel injection volume of the pump so that the control rod position is determined by both the flyweight assembly and the control member. Idling and main counterforce springs resist movement of the flyweight assembly in their respective engine speed ranges. The control member is arranged to bring a spring mechanism into engagement with the idling counterforce spring when moved beyond a certain point to demand higher engine speed. The spring mechanism acts against the idling counterforce spring to move the control rod to reduce the fuel injection volume when the speed control member is moved from its idling speed position to demand rapid acceleration while the idling counterforce spring remains engaged with the flyweight assembly to prevent excessive fuel injection volume.

10 Claims, 4 Drawing Figures

FUEL INJECTION PUMP GOVERNOR

The present invention relates to a centrifugal fuel injection pump governor especially suitable for a supercharged compression ignition engine.

Centrifugal governors are well known in the art to control the fuel injection volume of fuel injection pumps for engines such as supercharged Diesel engines to control the engine speed. A typical governor to which the present invention is applicable comprises a control rod connected to the fuel injection pump to control the fuel injection volume, a flyweight assembly driven by the pump camshaft, a speed control lever or pedal and a linkage connecting the flyweight assembly and control lever to the control rod. Movement of either the control lever or the flyweight assembly causes the control rod to move. Idling and main counterforce springs are provided to resist movement of the flyweight assembly in their respective engine speed ranges.

A problem encountered in such a governor is that when the control lever is moved to demand rapid acceleration from idling speed, especially under heavy engine load operation, the engine exhaust will contain noxious black smoke since the supercharger cannot provide an increased air supply quickly enough to oxidize the greatly increased amount of fuel injected thereinto.

This problem may be overcome by providing a diaphragm assembly resporsive to the supercharger air pressure to limit the movement of the control rod to a range in which black smoke is not produced. Such a diaphragm assembly, however, adds considerably to the cost and complexity of the governor.

It is therefore an object of the present invention to provide an improved governor which prevents black smoke from being produced by the engine.

It is another object of the present invention to provide a governor which is simple in construction and inexpensive to produce.

It is another object of the present invention to provide a governor comprising a spring assembly controlled by the speed control member to apply a force to the idling counterforce spring in a direction opposite to the force thereof to decrease the fuel injection volume and prevent the production of black smoke when the speed control member is rapidly moved from an idling speed position to a high speed position.

The above and other objects, features and advantages of the present invention will become clear from the following detailed description taken with the accompanying drawings, in which.

Figure 1:
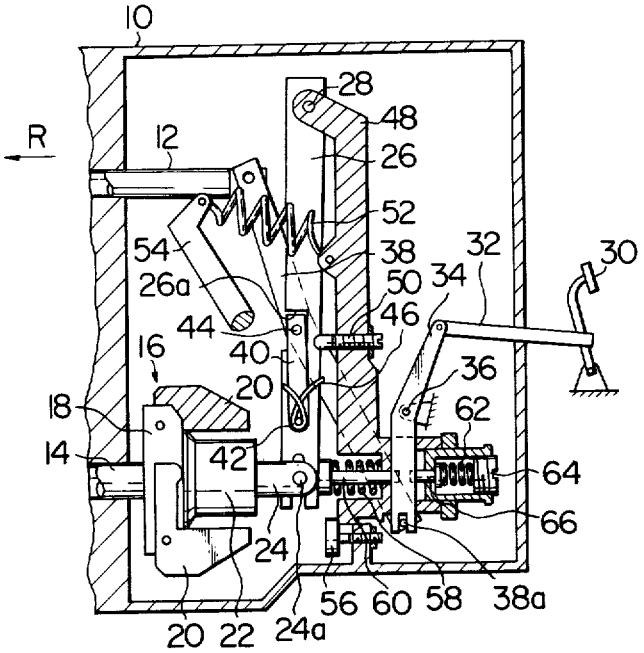
Fig. 1 PRIOR ART
FIG. 1 is a plan view of a prior art governor.

Referring now to FIG. 1, a prior art governor for a fuel injection pump of a supercharged Diesel engine (not shown) comprises a casing 10 through which a fuel injection volume control member or control rod 12 is slidable. The control rod 12 is formed with a rack engagable with control segments of control sleeves of plungers of the fuel injection pump (not shown) in a well known manner. A camshaft 14 of the fuel injection pump is driven by the engine and causes a flyweight assembly 16 to rotate therewith. The flyweight assembly 16 includes a plate 18 fixed to the camshaft 14 and flyweights 20 pivotally carried by the plate 18. A control sleeve 22 is moved left and right as viewed in FIG. 1 by the flyweights 20 and has a rod 24 fixed thereto. An intermediate lever 26 is pivotal about a fixed pin 28 at one end and is formed with a slot (no numeral) at its other end in which a pin 24a fixed to the rod 24 is slidable.

A speed control member is shown as an accelerator pedal 30 which is pivotal about its bottom end. An intermediate point of the pedal 30 is pivotally connected to one end of a link 32, the other end of which is pivotally connected to one end of a lever 34. The lever 34 is pivotal about a fixed intermediate point 36. A floating lever 38 is pivotally connected at one end to the control rod 12 and has a pin 38a fixed to its other end which is slidable in a slot (no numeral) formed in the bottom end of the lever 34.

A link 40 is pivotally connected at one end to an intermediate pin 44 of the floating lever 38 and at the other end to an intermediate pin 42 of the intermediate lever 26. The pin 44 extends through a cutout 26a in the intermediate lever 26, and a spring 46 connected between the intermediate lever 26 and the link 40 urges the link 40 clockwise so that the pin 44 abuts against the right side of the cutout 26a.

A support arm 48 is pivotal about the point 28 and carries an adjustable stop 50 engagable with the link 40. An extension main counterforce spring 52 connected between a fixed member 54 and the support arm 48 urges the support arm 48 clockwise to abut against a stop 56. A compression idling counterforce spring 58 is disposed between the support arm 48 and a pin 60 and urges the pin 60 into engagement with the rod 24. A compression compensating counterforce spring 62 is disposed in a chamber (no numeral) in the support arm 48 between a plug 64 and a pin 66. The left end of the pin 66 extends through the left wall of the chamber and is engagable with the right end of the pin 60. The spring 62 urges the pin 66 leftward so that a shoulder (no numeral) of the pin 66 abuts against the left wall of the chamber.

The governor shown in FIG. 1 is essentially similar in overall configuration to a governor disclosed in U.S. Pat. No. 3,672,343 to Biechl et al., except that in said prior art disclosure the bottom end of the floating lever is pivotal about a fixed point rather than being movable by the speed control member. In said prior art disclosure, a member corresponding to the fixed member 54 in FIG. 1 is movable to control the engine speed. This enables speed control only above the idling range. The governor shown in FIG. 1 is more advantageous since it allows speed control over the entire engine speed range.

The operation of the prior art governor will now be described with reference to FIGS. 1 and 4.

The pedal 30 is movable from a minimum engine speed position shown in FIG. 1 in the counterclockwise direction to increase the engine speed. The minimum speed position may be an engine stop position or an idling position. It will be in this case assumed as an idling position, with a stop lever (not shown) provided to stop the engine.

Figure 4:
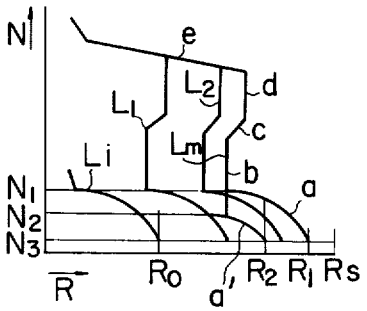
FIG. 4 is a graph illustrating the operation of the governors shown in FIGS. 1, 2, 3 and 4.

Referring also to FIG. 4, the ordinate represents the engine speed N and the abcissa represents the leftward displacement or position R of the control rod 12 from its rightmost position of minimum fuel injection volume.

The idling range of the engine is between speeds $N_3$ and $N_1$. Curves $L_i$, $L_1$, $L_2$ and $L_m$ represent the position R of the control rod 12 as a function of engine speed N for various positions of the pedal 30 which correspond to no-load, light intermediate load, heavy intermediate load and maximum load engine operation respectively.

To start the engine, the operator depresses the pedal 30 to its maximum extent moving the control rod 12 to its maximum leftward extent Rs to provide maximum fuel injection volume for starting the engine. After the engine speed rises to the minimum idling speed $N_3$, the operator releases the pedal 30 and the governor components assume the positions shown in FIG. 1.

It will be assumed that the engine is unloaded (not connected to a load such as a vehicle) and the pedal 30 is in its idling position corresponding to the curve $L_i$. The engine speed is $N_3$ and the control rod position is $R_o$. The operator then depresses the pedal 30 to the maximum load position corresponding to the curve $L_m$. This counterclockwise rotation of the pedal 30 moves the link 32 leftward rotating the lever 34 counterclockwise about the pin 36. This causes the floating lever 38 to rotate counterclockwise about the pin 44 to move the control rod 12 leftward to a new position $R_1$. The increased fuel supply causes the engine speed to increase as shown by a curve portion (*a*) of the curve $L_m$. As the engine speed increases, the flyweights 20 are pivoted outward by centrifugal force to move the sleeve 22 and rod 24 rightward against the force of the idling counterforce spring 58. This causes the intermediate lever 26 pivot counterclockwise about the pin 28 and pivot the floating lever 38 clockwise about the pin 38a thereby moving the control rod 12 rightward in a manner indicated by the curve portion (*a*). When the engine speed reaches $N_1$, the right end of the pin 60 abuts against the left end of the pin 66 so that rightward movement of the rod 24 is opposed by the combined force of the idling and compensating springs 58 and 62. The control rod 12 is prevented from further movement until the force of the flyweights 20 overcomes the forces of the springs 58 and 62 as shown by a curve portion (*b*).

The governor is constructed so that the link 44 is arranged to abut against the stop 50 just as the pin 60 abuts against the pin 66. As the force of the flyweights 20 overcomes the forces of the springs 58 and 62, the intermediate lever 26 pivots further counterclockwise about the pin 28. The spring 62 yields, and the link 44 rotates counterclockwise about its point of contact with the stop 50, which is between the pins 42 and 44. This causes the floating lever 38 to pivot counterclockwise about the pin 38a and move the control rod 12 leftward as shown by a curve portion (*c*).

Further rightward movement of the rod 24 due to increasing engine speed results in compression of the spring 62 to its solid length at which point the rod 24 is in effect connected to the support arm 48. Further movement of the control rod 24 will not occur until the force of the flyweights 20 overcomes the combined forces of the springs 58, 62 and 52 as shown by a curve portion (*d*). As the engine speed rises to a point at which the force of the flyweights 20 overcomes the forces of the springs 58, 62 and 52, the intermediate lever 26, support arm 48 and link 44 will pivot counterclockwise as a unit causing the floating lever 38 to pivot clockwise about the pin 38a and move the control rod rightward as shown by a curve portion (*e*).

At the engine speed $N_3$, the engine will emit black smoke when the control rod 12 position is between a point $R_2$ and the maximum position $R_s$ because the supercharger cannot produce enough air at the low speed $N_3$ to combust all of the fuel injected. This is an inherent problem in the prior art governor shown and described as mentioned above. Black smoke will be produced under all conditions in which the pedal 30 is depressed to its maximum load position or close thereto and the engine speed is close to $N_3$. These conditions occur while operating the engine under maximum load at idling speed and when the pedal 30 is depressed to provide rapid acceleration from idling speed.

Figure 2:
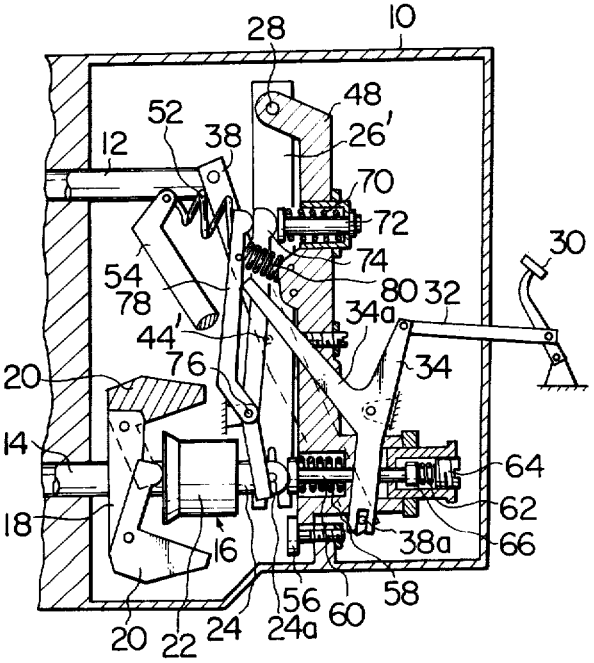
FIG. 2 is a plan view of a governor embodying the present invention.
Figure 3:
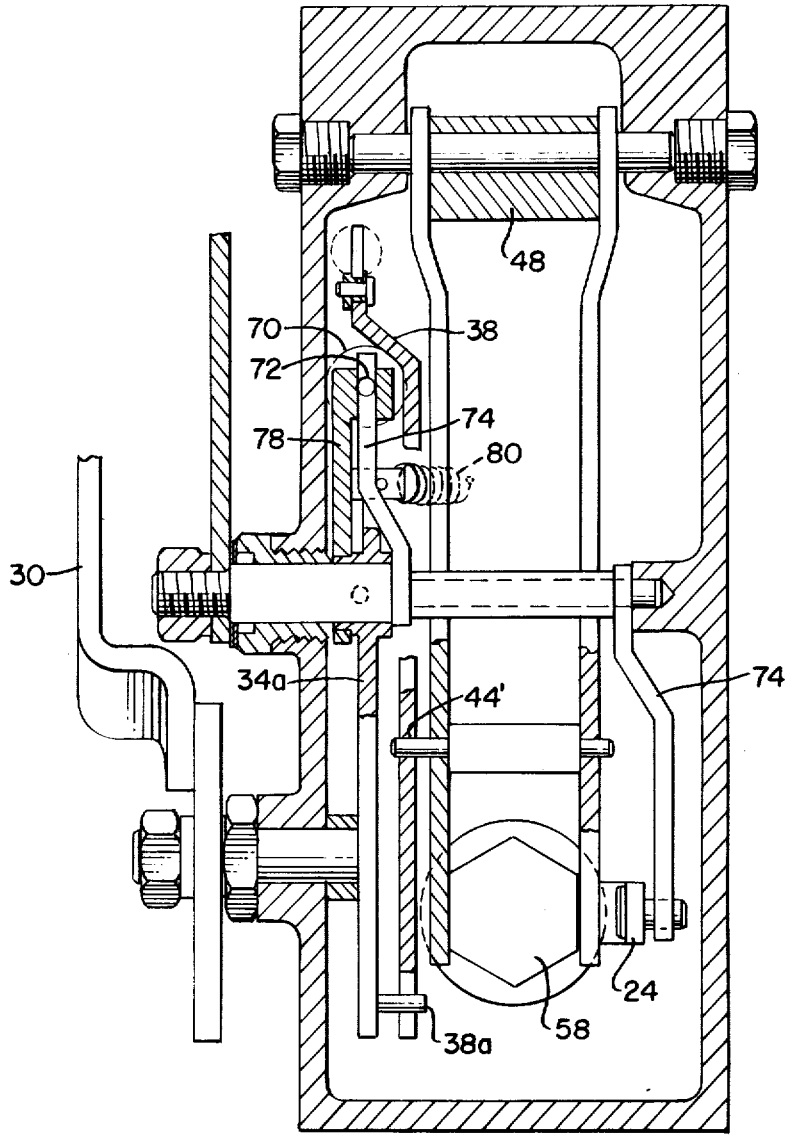
FIG. 3 is an end view of the governor shown in FIG. 2.

This problem is overcome by the present invention, one embodiment of which is shown in FIGS. 2 and 3. The governor of FIGS. 2 and 3 is identical to that shown in FIG. 1 except for the addition of elements which will be described below. The link 40 and spring 46 are not shown in FIGS. 2 and 3 for simplicity of illustration. The description of the low speed operation of the engine will also be simplified by assuming that a floating lever 26' is formed without a cutout and is directly pivotally connected to the floating lever 38 by a pin 44'.

The governor of FIGS. 2 and 3 comprises a spring assembly including a compression spring 70 disposed between the support arm 48 and a pin 72 urging the pin 72 leftward. A lever 74 is rotatable about a fixed pin 76. The left end of the pin 72 engages with the lever 74 to urge the lever 74 to rotate counterclockwise. The bottom end of the lever 74 is abuttingly engageable with the left side of the pin 24a so that the force of the spring 70 is transmitted by the pin 72, lever 74, pin 24a, rod 24 and pin 60 to the idling counterforce spring 58. The force of the spring 70 acts on the spring 58 in a direction opposite to the force of the spring 58.

Another lever or arm 78 is pivotal about the pin 76 and is urged into engagement at its upper end with the lever 74 by an extension spring 80. The spring 80 is strong enough to rotate the arm 78 clockwise against the force of the spring 70 to compress the spring 70 and rotate the lever 74 clockwise to disengage from the pin 24a. The lever 34 is provided with an arm 34a which is arranged to engage with the right edge of the arm 78 to rotate the same counterclockwise against the force of the spring 80 when the pedal 30 is rotated counterclockwise from the minimum speed position beyond a certain extent.

The operation of the embodiment of the present invention shown in FIGS. 2 and 3 is identical to the prior art governor shown in FIG. 1 as represented by the curve portions (*b*), (*c*), (*d*) and (*e*) when the link 44 and spring 46 are provided in an identical manner. The low speed operation of the present governor is different in its low speed, maximum load operation as will be described below.

Again it will be assumed that the engine is at the idling speed $N_3$ under no load conditions with the control rod at the position $R_o$. The operator then depresses the pedal 30 to the maximum load position. The components are urged as described above to urge the control rod 12 toward the position $R_1$. However, the arm 34a engages with the arm 78 rotating the arm 78 counterclockwise against the force of the spring 80. This allows the spring 70 to rotate the lever 74 counterclockwise so that the lower end of the lever 78 engages with the left side of the pin 24a thereby urging the rod 24 rightward against the force of the idling counterforce spring 58. This urges the intermediate lever 26' to pivot counterclockwise about the pin 28 and the floating lever 38 to pivot clockwise about the pin 24a in superposition with the movement caused by depressing the pedal 30. As the resultant of these movements the control rod 12 assumes a position between $R_o$ and $R_2$ at which black smoke is not produced by the engine. As the engine speed rises to a value $N_2$ which is between $N_3$ and $N_1$, the pin 60 abuts against the pin 66 and further movement of the rod 24 is prevented until the combined force of the flyweights 20 and the spring 70 is sufficient to overcome the force of the springs 58 and 62. The spring 70 is arranged to be fully extended as the spring 62 begins to yield so that further rightward movement of the rod 24 causes the pin 24a to move away from the lever 74. In this manner, the spring assembly does not affect the operation of the governor above the idling speed range. This operation if shown by a broken live curve portion *a'*.

Although the operation of the present invention was described for the engine under no-load conditions, proper operation is clearly attained when the engine is connected to a load such a vehicle. If the engine load is light as shown by the curve $L_1$, the control rod 12 position will never exceed $R_2$. At a higher load as shown by the curve $L_2$, the spring assembly will produce the curve portion *a'* as in the case of maximum load operation.

Many modifications are possible within the scope of the present invention. The point of engagement of the arm 34a with the arm 78, the strength of the spring 70 relative to the springs 58 and 62, the points of engagement and disengagement of the lever 74 with the pin 24a and similar factors may be changed freely to meet the particular requirements of the governor. The springs 70 and 80 may be connected to the casing 10 rather than to the support arm 48. The lever 74 may be arranged to either completely or partially compress the spring 58 when the arm 78 is engaged by the arm 34a. The spring 62 may be omitted. The pin 38a may be fixed and the pin 44' movable to manually change the engine speed. The support arm 48 may be omitted and a spring serving the function of the spring 52 disposed between the rod 24 and the casing 10. In general, the spring 80 is strong enough to compress the spring 70, and the spring 70 is sufficient to at least partially compress the spring 58 at engine speeds greater than $N_3$ but less than $N_1$ and the force of the spring 70 is insufficient to compress the combination of the springs 58 and 62 at engine speeds below $N_1$.

What is claimed is:

1. In a fuel injection pump governor having a fuel injection control member, an engine speed control member movable from a minimum engine speed position in a direction to increase engine speed, an engine driven flyweight assembly, a linkage connecting the flyweight assembly to the fuel injection control member so that movement of the flyweight assembly causes movement of the fuel injection control member, the linkage further connecting the speed control member to the fuel injection control member so that movement of the speed control member causes movement of the fuel injection control member and an idling counterforce spring to resist movement of the flyweight assembly when the engine speed is below a predetermined value, the improvement comprising:

a spring assembly engageable with the idling counterforce spring to apply a force thereto in a direction opposite to the force of the idling counterforce spring;

the speed control member being engageable with the assembly to cause the spring assembly to be disengaged from the idling counterforce spring when the speed control member is between the minimum engine speed position and a predetermined position spaced from the minimum engine speed position in the direction to increase engine speed and cause the spring assembly to engage with the idling counterforce spring when the speed control member is spaced farther from the minimum engine speed position that the predetermined position in the direction to increase engine speed.

2. The governor of claim 1, in which the spring assembly comprises:

a first spring;

a first lever connected to the first spring so that the first spring urges the first lever to engage with the idling counterforce spring to transmit the force of the first spring thereto; and means engageable with the first lever to normally hold the first lever out of engagement with the idling counterforce spring, the speed control member engaging with said means when the speed control member is spaced farther from the minimum engine speed position than the predetermined position in the direction to increase the engine speed to cause said means to release the first lever to allow the first lever to engage with the idling counterforce spring.

3. The governor of claim 2, in which said means comprises:

a second lever engageable with the first lever; and a second spring connected to the second lever to urge the second lever to engage with the first lever to move the first lever out of engagement with the idling counterforce spring against the force of the first spring, the speed control member engaging with the second lever when the speed control member is spaced farther from the minimum engine speed position than the predetermined position in the direction to increase the engine speed to move the second lever against the force of the second spring to allow the first spring to move the first lever to engage with the idling counterforce spring.

4. The governor of claim 3, in which the first and second levers are pivotal about a common fixed point.

5. The governor of claim 1, in which the linkage includes a first lever pivotal at one end about a fixed point and pivotally connected at the other end to the flyweight assembly, a second lever pivotally connected at an intermediate point thereof to an intermediate point of the first lever, the second lever being pivotally connected at one end to the fuel injection volume control member and connected at the other end to the speed control member.

6. The governor of claim 3, further comprising a third lever pivotal at one end about a fixed point, a stop and a main counterforce spring urging the third lever against the stop, the flyweight assembly engaging with the third lever to urge the third lever away from the stop against the force of the main counterforce spring when the engine speed is above the predetermined value.

7. The governor of claim 6, in which the first spring is connected between the first and third levers and the second spring is connected between the second and third levers.

8. The governor of claim 7, in which the first spring is a compression spring and the second spring is an extension spring.

9. The governor of claim 6, in which the idling counterforce spring is connected between the flyweight assembly and the third lever.

10. The governor of claim 9, in which the idling counterforce spring is a compression spring.

* * * * *